US009454892B2

(12) United States Patent
Pfannenberg

(10) Patent No.: US 9,454,892 B2
(45) Date of Patent: Sep. 27, 2016

(54) DEVICE TO MONITOR A SOUND GENERATOR, IN PARTICULAR AN ALARM SOUND GENERATOR, AND A CORRESPONDING SOUND GENERATOR, AND A RELATED METHOD

(75) Inventor: Andreas Pfannenberg, Hamburg (DE)

(73) Assignee: Pfannenberg GmbH, Hamburg (DE)

( * ) Notice: Subject to any disclaimer, the term of this patent is extended or adjusted under 35 U.S.C. 154(b) by 1317 days.

(21) Appl. No.: 12/949,381

(22) Filed: Nov. 18, 2010

(65) Prior Publication Data

US 2011/0123035 A1 May 26, 2011

(30) Foreign Application Priority Data

Nov. 23, 2009 (DE) ..... 20 2009 015 910 U
Jan. 26, 2010 (DE) ..... 20 2010 001 322 U

(51) Int. Cl.
*H04R 29/00* (2006.01)
*G08B 29/10* (2006.01)

(52) U.S. Cl.
CPC ..... *G08B 29/10* (2013.01); *H04R 29/00* (2013.01); *H04R 29/001* (2013.01); *H04R 29/007* (2013.01)

(58) Field of Classification Search
CPC .... G08B 29/10; H04R 29/00; H04R 29/001; H04R 29/007
USPC ..... 381/59, 58, 120, 122, 82, 80, 77, 56, 381/150, 96, 55; 340/384.1, 384.4, 384.7; 324/509, 500, 522
See application file for complete search history.

(56) References Cited

U.S. PATENT DOCUMENTS

| | | | | |
|---|---|---|---|---|
| 4,037,222 | A | 7/1977 | Solomon | |
| RE29,580 | E * | 3/1978 | Goodwater | 340/507 |
| 5,638,043 | A * | 6/1997 | Sakai et al. | 340/384.6 |

FOREIGN PATENT DOCUMENTS

| | | | |
|---|---|---|---|
| CH | 682856 | A5 | 11/1993 |
| DE | 37 17 369 | A1 | 5/1987 |
| DE | 3624099 | A1 | 1/1988 |
| DE | 3536701 | C2 | 6/1994 |
| DE | 196 33 863 | A1 | 8/1996 |
| DE | 29611600 | U1 | 9/1996 |
| DE | 100 20 862 | A1 | 4/2000 |
| DE | 10020862 | A1 | 11/2001 |
| DE | 202006018730 | U1 | 3/2007 |
| DE | 102005057634 | A1 | 8/2007 |
| JP | H3-177998 | A | 8/1991 |
| WO | 2008/132475 | A1 | 11/2008 |

OTHER PUBLICATIONS

Germany Office Action dated Aug. 9, 2013 for the Application No. DE102010044016.7.
Great Britain Search Report dated Mar. 17, 2011 for the Application No. GB1019507.1.

* cited by examiner

*Primary Examiner* — Vivian Chin
*Assistant Examiner* — Con P Tran
(74) *Attorney, Agent, or Firm* — Kelly & Kelley, LLP

(57) ABSTRACT

A device for monitoring a sound generator includes at least one coupler module, a signal evaluation element, and an output element. The device is coupled by at least one coupler module with the sound generator for purposes of monitoring the latter.

5 Claims, 2 Drawing Sheets

Figure 1:
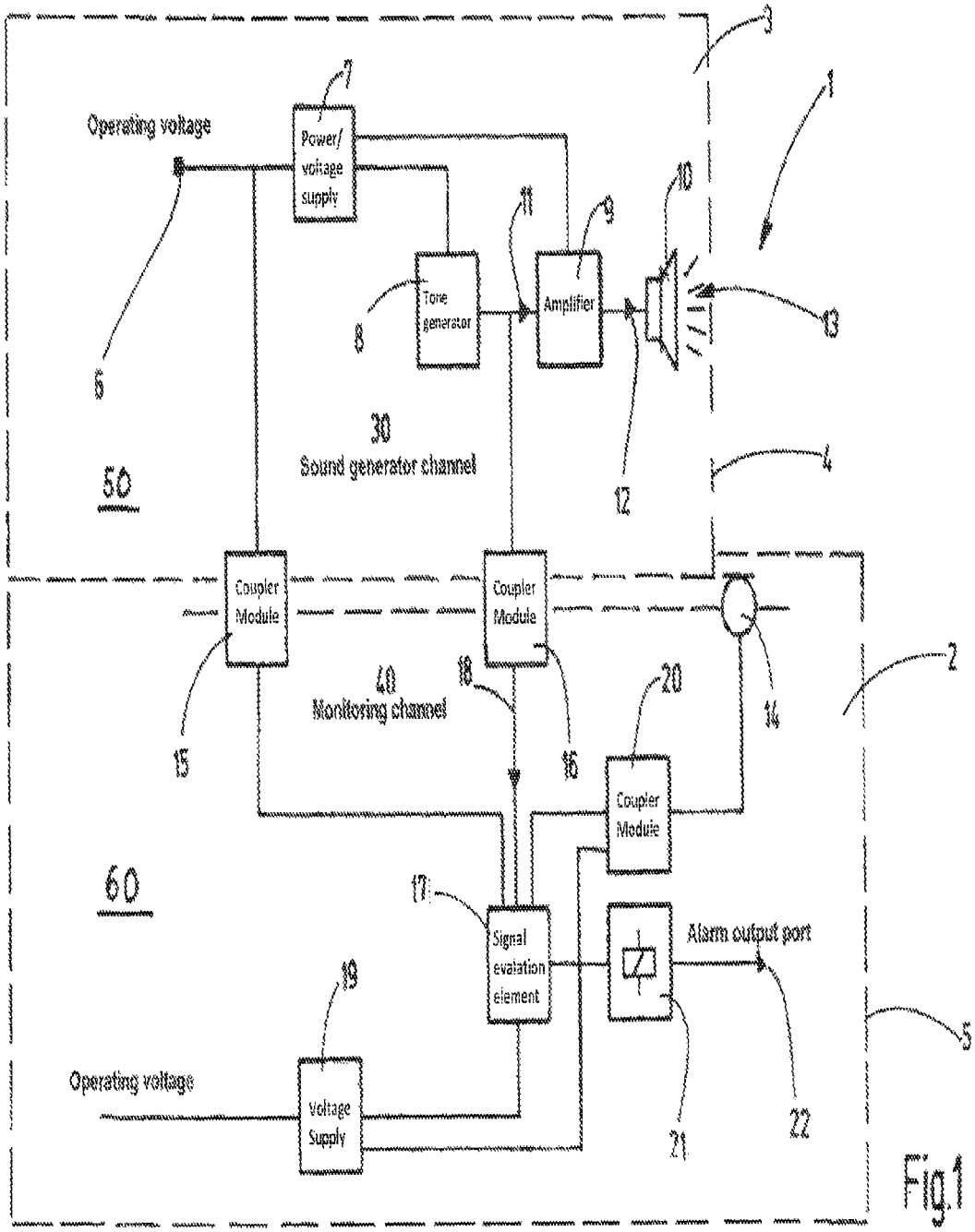

DEVICE TO MONITOR A SOUND GENERATOR, IN PARTICULAR AN ALARM SOUND GENERATOR, AND A CORRESPONDING SOUND GENERATOR, AND A RELATED METHOD

TECHNICAL FIELD

The invention concerns a device to monitor a sound generator, in particular an alarm sound generator having at least one coupler module, a signal evaluation element and an output element, and a corresponding sound generator, and a related method.

BACKGROUND OF THE INVENTION

Sound generators are today used in many different types of applications. Thus, in particular, they are often used in warning or alarm devices, in which a warning signal can be outputted in a controlled manner as a function of a detected event. Thus such alarm devices are used, for example, as fire alarm systems, burglar alarm systems, transit alarm systems, entry alarm systems, or also to monitor machines or vehicles, to record specific events by means of a sensor and to trigger and correspondingly generate appropriate alarm signals.

Since the users of such warning or alarm devices rely on the reliable functioning of the device, it is essential that in particular the sound generator also operates reliably in such a warning or alarm device.

From DE 100 20 862 A1 a sound generator of an alarm device has become of known art, in which the sound generator, here designated as a signal generator, is associated with a checking device, which receives and processes the acoustic signal emitted by the sound generator, or forwards it to an evaluation unit, which then evaluates the acoustic signal. Here the checking device is simply tuned to the signal outputted from the signal generator, which in the case of a sound generator is the acoustic signal. Thus the possibility of an error exists, if, instead of the warning signal from the sound generator that is being monitored, another signal from a neighbouring signal generator is detected, for example, or a signal that is incorrect in some other respect. In such cases it would be assumed that the signal originated from the signal generator being monitored, and the signal generator would be considered to be fault-free, although in actual fact this would not be the case.

DE 196 33 863 A1 discloses an alarm system for monitoring a plurality of objects, in particular intrusion monitoring of houses, with a plurality of alarm systems associated with one object; these alarm systems include a sensor, which is designed to detect an event triggering an alarm. The alarm system also includes a transmission unit, which forwards the alarm signal identifying the alarm state and an identification signal identifying the object to other alarm systems, so that where there is a large number of neighbouring alarm systems the alarm state of one alarm system is fed in so that the residents can take appropriate measures. However, no fault monitoring and/or monitoring of the reliable functioning of a sound generator takes place in this case.

DE 37 17 369 A1 discloses a method and a device for monitoring a space in which an additional signal generator is used; this outputs a signal that is received by the detector of the system, and the detector output port signal and the signal controlling the signal generator are compared. On the basis of this comparison optimal operation of the device is derived and any improper manipulation is excluded. However, no explicit fault monitoring and/or monitoring of the reliable functioning of a sound generator takes place in this case, since the signal from the sound generator is not included in the check, but just the detector signal, which activates the sound generator if an incident occurs.

PRESENTATION OF THE INVENTION: OBJECT, SOLUTION, ADVANTAGES

The object of the invention is to enable reliable testing of a sound generator, in particular an alarm sound generator, in that an improved device to monitor a sound generator is created and a corresponding sound generator is created, in order also to increase the reliability of a monitoring system. The object is furthermore to create such a sound generator and a related method.

This is achieved with a device created to monitor a sound generator, in particular an alarm sound generator, with at least one coupler module, a signal evaluation element and an output port element, wherein the device is coupled by means of at least one coupler module with the sound generator so as to monitor the latter.

It is particularly advantageous if a first coupler module is used to monitor the operating voltage of the sound generator. By this means one can monitor whether a signal should actually be activated or perhaps not. If the voltage is present, this is interpreted as an intentional activation of a signal. If the signal is missing this is interpreted as an unintentional transmission of an acoustic signal, in other words as the absence of a warning.

Also it is advantageous if a second coupler module is used to monitor the tone signal of the sound generator. By this means one can monitor whether a tone signal is being generated so as to generate an acoustic signal. Here the tone signal is formed by a tone generator and forwarded to a loudspeaker, which generates the acoustic signal on the basis of the tone signal.

Also it is furthermore advantageous if a third coupler module is used to monitor the acoustic signal of the sound generator. By this means one can monitor whether an acoustic signal is being generated or not.

Here it is advantageous if the at least one coupler module is connected to the signal evaluation element. By this means the evaluation element receives the information directly via at least one signal cable.

It is particularly advantageous if the device monitors the operating voltage, and/or the tone signal, and/or the acoustic signal. Thus a combination of signals can be used so as to achieve a higher level of reliability.

Also it is advantageous if the monitoring device has an operating voltage supply that is separate from the operating voltage supply to the signal generator. By this means the monitoring device can operate autonomously, which contributes significantly to its operational reliability.

Furthermore it is advantageous if the signal evaluation element and the output port element are supplied with the operating voltage.

With reference to the sound generator the task in accordance with the invention is achieved with a sound generator with a voltage supply, a tone generator, an amplifier and a loudspeaker, wherein the sound generator is coupled with coupler modules for purposes of monitoring the operating voltage, and/or the tone signal, and/or the acoustic signal.

Here it is advantageous if the tone generator and the amplifier are supplied by means of the voltage supply.

In accordance with a further embodiment of the invention, monitoring takes place acoustically and electronically, wherein evaluation takes place on the basis of a plurality of information sources and the combination of the following items of information is used for the evaluation: 1.) the tone is generated, 2.) an electrical image is created of the type of tone generated, and 3.) the acoustic signal is generated, where the requirement as to whether a tone should be generated is taken to be the presence of the operating voltage on the sound generator channel, and the image of the type of tone generated provides the tone signal structure for a target-actual comparison, where the presence of the acoustic signal can be checked and with these items of information a target-actual comparison can be executed and any fault event can be outputted at an output port for further processing.

Moreover the invention comprises a device to monitor a sound generator, in particular an alarm sound generator, which consists of a system with two functionally interacting components, of which the first component is designed as a sound generator, or a sound generator channel, which consists of the three important function blocks: power supply, tone generator, amplifier and loudspeaker, where the power supply ensures the necessary supply voltage for all parts of the circuit, where low-power tone signals are generated in the tone generator at different frequencies and/or with different structures, where the tone signal is fed to the input of a power amplifier, where the loudspeaker signal present at the output port is converted into acoustic signals at a high sound power level, where by the electronic generation of the tone signal tones are very different in their structures, with the advantage that people can differentiate between the types of tones and thus their information content very much more easily, where the types of tones can be selected manually or by electrical activation, and the second component is designed as a monitoring device, or a monitoring channel, which provides the analysis of correct functioning of the sound generator channel, where a plurality of information sources are evaluated, enabling a reliable assessment of the sound generator channel (operating voltage on the sound generator channel, the tone signal generated in the tone generator and the acoustic signal generated are used), where at the alarm output port of the monitoring channel the information provided from the signal evaluation as to whether the signal generator is operating correctly is tapped for further processing in an application, where a coupler module provides the information for the requirement that the sound generator should generate an acoustic signal, by checking the operating voltage on the sound generator channel, where via the coupler module the output signal of the tone generator is processed, and the signal evaluation is provided to ensure that tone intervals that arise from the type of tone and/or the tone pattern, and other types of tones, are detected as such and are not interpreted as fault events, where a target-actual comparison is undertaken for the acoustic signal, where acoustic monitoring is enabled via the coupler module and the microphone, where one can ascertain whether an activated tone signal is also acoustically generated, where by multi-level monitoring of the sound generator channel, including an acoustic check, a high level of functional reliability can be achieved for applications, despite very different tone signals.

With reference to the method, the object in accordance with the invention is achieved with a method for the operation of a device to monitor a sound generator, with at least one coupler module, a signal evaluation element and an output port element, where the device is coupled with the sound generator by means of at least one coupler module so as to monitor the sound generator.

Here it is advantageous if a first coupler module is used to monitor the operating voltage of the sound generator.

Advantageously a second coupler module is used here to monitor the tone signal of the sound generator.

Advantageously a third coupler module is used here to monitor the acoustic signal of the sound generator.

Here it is advantageous if the at least one coupler module is connected to the signal evaluation element. Here it is advantageous if the device monitors the operating voltage, and/or the tone signal, and/or the acoustic signal.

Further advantages are specified in the dependent claims and in the description of the figures, to which explicit reference is made.

SHORT DESCRIPTION OF THE DRAWINGS

In what follows the invention is elucidated in more detail on the basis of an example of embodiment with the aid of the drawings. In the figures, FIG. 1 shows a block diagram of a device to monitor a sound generator, together with such a sound generator, and FIG. 2 shows a block diagram to illustrate a method in accordance with the invention.

PREFERRED EMBODIMENT OF THE INVENTION

Figure 2:
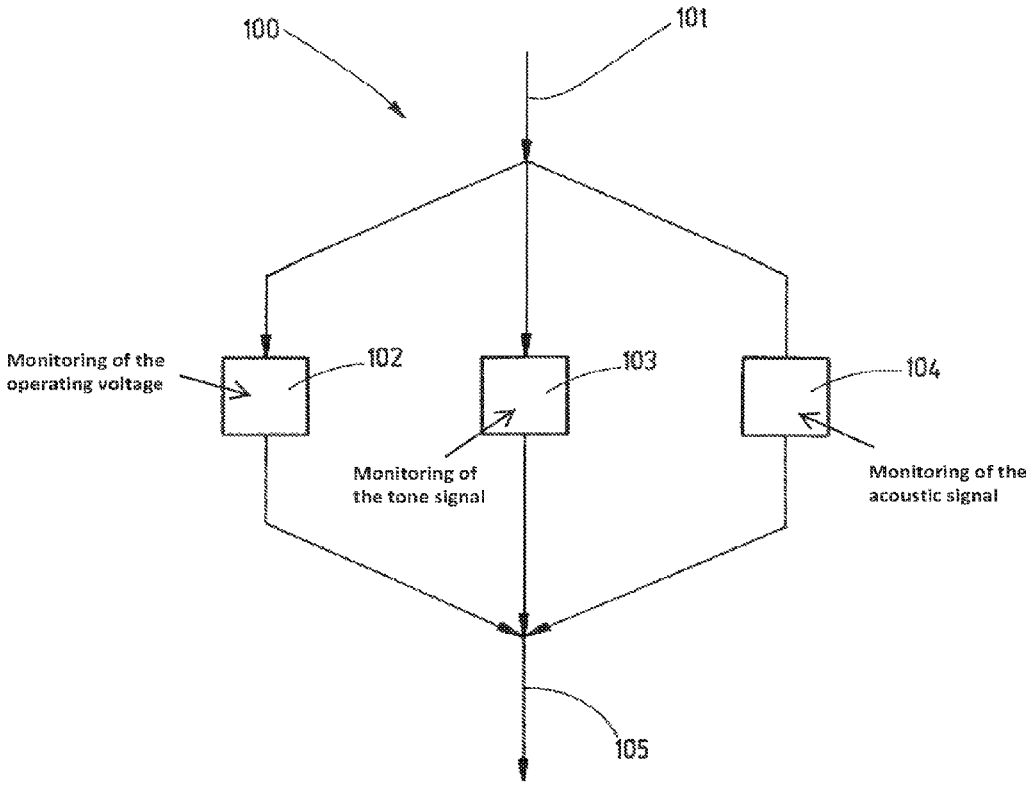

FIG. 1 shows schematically an arrangement 1 with a device 2 to monitor a sound generator 3, and such a sound generator 3.

The device 2 to monitor a sound generator 3, and the sound generator 3, are identified by the broken lines 4, 5 as separate components or units that can be designed independently of one another. In another example of embodiment the sound generator 3 and the device 2 to monitor the sound generator 3 can also be combined or integrated with one another. This can advantageously be accomplished by integrating the device 2 to monitor the sound generator 3 into the sound generator 3. Alternatively this can also advantageously be accomplished by integrating the sound generator 3 into the device 2 to monitor the sound generator 3.

The sound generator 3 has a voltage or power supply 7, which is supplied at the operating voltage, for which purpose a power/voltage supply port 6 is advantageously present. Also provided are a tone generator 8, an amplifier 9, and a loudspeaker 10.

The power supply 7 supplies the tone generator 8 and the power amplifier 9 with power/voltage and ensures an adequate supply voltage to the parts of the circuit.

The tone generator 8 generates low-power tone signals 11 at frequencies that can advantageously be controlled; depending on the form of activation these tone signals can also be of different designs. The tone generator can also generate a tone signal with a different structure or amplitude. Here it is furthermore advantageous if frequency, and/or structure or amplitude, can be modulated in a controlled manner.

Originating from the tone generator, the tone signal 11 is fed to the amplifier 9, which amplifies the signal, and at the output port of the amplifier 9 an amplified signal 12 is forwarded to the loudspeaker 10.

The signal 12 present at the loudspeaker 10 is converted by the loudspeaker 10 into an acoustic signal 13, preferably at a high sound power level.

Advantageously by means of the electronic generation of the tone signal 11 and thus also of the acoustic signal 13 these are controlled in a systematic manner such that when different signals are generated these signals can also be perceived by a person as different signals, so that they can definitely be provided with different information content. The persons perceiving the signal can perceive and detect the different information contents on the basis, for example, of the tone level and/or the modulation of the amplitude of the acoustic signal.

Here it is advantageous if the tone level and/or the modulation of the amplitude of the acoustic signal can be manually specified or electronically activated.

The device 2 to monitor the sound generator 3 has a microphone 14 to receive the acoustic signal 13.

The device furthermore has a first coupler module 15, which serves to couple the sound generator 3 and the device 2. This coupler module 15 is connected to, or can be coupled with, the voltage input port 6. Thus it provides the information for the requirement that the sound generator 3 should, or should not, generate an acoustic signal 13. This takes place in the course of checking the operating voltage. If the operating voltage is at the required level a signal should also be generated. If the operating voltage is essentially equal to zero the conclusion can be drawn that no warning signal should be generated.

The device has furthermore a second coupler module 16, which similarly serves to couple the sound generator 3 and the device 2. This coupler module 16 is connected to, or can be coupled with, the output port of the tone generator 8, and detects the tone signal 11 at the output port of the tone generator. Thus it makes the tone signal 11 information available to the element of the signal evaluation unit 17. However, the tone signal 11 can also be processed via the coupler module 16, such that a processed signal 18 is provided to the signal evaluation unit 17. This enables, for example, tone intervals of the signal that arise from the type of tone and/or the tone pattern to be detected as such and not interpreted as faults. This also applies to the detection of other types of tones, which are detected correctly and not interpreted as fault events.

The device furthermore has a third coupler module 20, which serves to couple the microphone 14 and the signal evaluation unit 17. This coupler module 20 serves to provide acoustic monitoring of the acoustic signal 13. By this means one can ascertain whether the acoustic signal that should be generated on the basis of the tone signal 11 is also actually generated and can be acoustically perceived.

This enables a target-actual comparison for the acoustic signal to be undertaken, because both the tone signal 11 and also the acoustic signal can be monitored and checked. Thus one can detect whether the acoustic signal 13 that is generated corresponds to the specification of the tone signal 11.

This design for sound generator monitoring enables multi-level monitoring of the sound generator.

Thus a first check of operating capability is enabled by a check on the operating voltage. Furthermore a second check is enabled by testing the tone signal 11. Likewise a third check is enabled by testing the acoustic signal 13. Advantageously a combination of the first, second, and/or third checks can be executed, depending on the example of embodiment.

Thus in a first example of embodiment just the operating voltage can be monitored. In another second example of embodiment just the tone signal 11 is monitored. In another third example of embodiment just the acoustic signal 13 is monitored. In a fourth example of embodiment the operating voltage and the tone signal 11 are monitored. In a fifth example of embodiment the operating voltage and the acoustic signal 13 are monitored. In a sixth example of embodiment the operating voltage, the tone signal 11, and the acoustic signal 13 are monitored.

Furthermore one must detect that the supply voltage for the monitoring device 2 is supplied by means of the operating voltage, which is preferably separate from the operating voltage of the sound generator. The supply voltage 19 supplies the signal evaluation unit 17 and the acoustic coupler module 20.

If a fault is detected, so that either the operating voltage does not correspond to specification, and/or the monitored tone signal 11 does not correspond to specification, and/or the acoustic signal 13 does not correspond to specification, then by means of the control element or output element 21 an alarm signal 22 is generated and outputted at the alarm output port.

FIG. 2 shows schematically a block circuit diagram 100 for the monitoring of the sound generator. Here a monitoring requirement is set with the arrow 101 and a check is made in blocks 102, 103 and/or 104 whether the appropriate signals are present and/or agree with required signals. Block 102 represents monitoring of the operating voltage, block 103 represents monitoring of the tone signal 11, and block 104 represents monitoring of the acoustic signal 13.

Arrow 105 represents whether a fault signal is outputted at the output port 22. In total one must ascertain that the monitoring device 2 can monitor and/or check the sound generator 3 acoustically, and/or electrically, and/or electronically. Advantageously, however, the evaluation of functional serviceability is made on the basis of a plurality of signals and/or information sources. Here it is advantageous if a combination of the following items of information or signals is used: a signal that the tone should be generated, which typically takes place via detection of the operating voltage; a signal that the electrical image corresponds to that of the tone generated, in other words the tone signal 11 and/or an acoustic signal 13.

Here it is assumed that an acoustic signal 13 should be generated if the operating voltage is detected on the sound generator 3 or on the sound generator channel.

Accordingly the sound generator 3 or the sound generator channel 30 consists of the three important function blocks: power supply 7, tone generator 8, amplifier 9 and loudspeaker 10. The power supply ensures the necessary voltage is supplied to all parts of the circuit. In the tone generator 8 low-power tone signals are generated at different frequencies and/or with different structures. The tone signal is fed to the input of the amplifier 9. The loudspeaker 10 converts the signal present at the output port into acoustic signals at a high sound power level. By means of the electronic generation of the tone signal tones can be very different in their structures, with the advantage that people can differentiate between the types of tones and thus their information content very much more easily. The types of tones can be selected manually or by electrical activation.

The device 2, i.e. the monitoring channel 40, provides the analysis of correct functioning of the sound generator channel 30. For this purpose a plurality of information sources are evaluated; these enable a reliable assessment of the sound generator channel 30. In the present configuration these are: the presence of the operating voltage at the sound generator channel 30, the tone signal generated in the tone generator 8, and the acoustic signal generated. At the alarm output port 22 of the monitoring channel 40, the information provided by the signal evaluation of the signal evaluation element 17, as to whether the sound generator 3 is operating correctly, can be tapped for further processing in an application.

The coupler module 15 provides the information regarding the requirement that the sound generator 3 should generate an acoustic signal, in that the operating voltage is checked on the sound generator channel 30. Via the coupler module 16 the output signal of the tone generator 8 is processed and fed to the signal evaluation unit 17. By this means one can ensure that tone intervals, for example, which arise from the type of tone and/or from the tone pattern, as well as other types of tones, are detected as such and not interpreted as fault events. A target-actual comparison can be undertaken for the acoustic signal. Acoustic monitoring is enabled via the coupler module 15 and the microphone 14. Here one ascertains whether activation of a tone signal is also generating an acoustic signal. By means of the multi-level monitoring of the sound generator channel, including an acoustic check, a high level of functional reliability can be achieved for applications (FIG. 1), despite very different tone signals.

LIST OF REFERENCE SYMBOLS

1 Arrangement
2 Device
3 Sound generator
4 Cable
5 Cable
6 Power/voltage supply port
7 Power/voltage supply
8 Tone generator
9 Amplifier
10 Loudspeaker
11 Tone signal
12 Amplified signal
13 Acoustic signal
14 Microphone
15 Coupler module
16 Coupler module
17 Signal evaluation element
18 Processed signal
19 Voltage supply
20 Coupler module
21 Control and/or output element
22 Alarm signal (alarm output port)
30 Sound generator channel
40 Monitoring channel
50 First component
60 Second component
100 Block diagram
101 Arrow
102 Block
103 Block
104 Block
105 Arrow

The invention claimed is:

1. A device for monitoring a sound generator, comprising:

a system of two functionally interacting components, including:

a first component designed as a sound generator or sound generator channel having three important function blocks, including a power supply, a tone generator, and amplifier and/or a loudspeaker, wherein the power supply ensures the necessary supply voltage for all parts of a circuit, wherein low-power tone signals are generated in the tone generator with different frequencies and/or different structures, wherein a tone signal is fed to the input port of a power amplifier, wherein the signal present at the output port of the loudspeaker is converted into acoustic signals, wherein due to electronic generation of the tone signal tones differ in their structure with the advantage that people can differentiate between the types of tones and thus their information content, wherein the types of tones can be selected manually or by electrical activation; and a second component designed as a monitoring unit or a monitoring channel for analysing the correct functioning of the sound generator channel, wherein a plurality of information sources for the analyzing are evaluated, which enable an assessment of the sound generator channel, wherein the tone signal generated in the tone generator and the generated acoustic signal are utilized, wherein at an alarm output port of the monitoring channel the information provided from the signal evaluation as to whether the sound generator is operating correctly is tapped for further processing in an application, wherein a coupler module provides the information regarding the requirement that the sound generator should generate an acoustic signal in that the operating voltage on the sound generator channel is checked, wherein via the coupler module the output signal of the tone generator is processed and provided to the signal evaluation to ensure that tone intervals that arise from the type of tone and/or the tone pattern as well as other types of tones are detected as such and are not interpreted as fault events, wherein the tone signal and the acoustic signal being monitored and check enabling a target-actual comparison for the acoustic signal to be undertaken, wherein acoustic monitoring is enabled via the coupler module and a microphone, wherein it can be ascertained whether activation of the tone signal is also generating the acoustic signal, wherein by means of multi-level monitoring of the sound generator channel, including an acoustic check, can be achieved for applications, despite very different tone signals.

2. The device in accordance with claim 1, wherein the coupler module comprises a first coupler module used to monitor the operating voltage of the sound generator.

3. The device in accordance with claim 2, wherein the coupler module comprises a second coupler module used to monitor the tone signal of the sound generator.

4. The device in accordance with claim 3, wherein the coupler module comprises a third coupler module used to monitor the acoustic signal of the sound generator.

5. The device in accordance with claim 4, wherein the coupler module is connected to a signal evaluation element.

* * * * *